US006676495B1

(12) United States Patent
Siemers et al.

(10) Patent No.: US 6,676,495 B1
(45) Date of Patent: Jan. 13, 2004

(54) POWER SHARPENING SYSTEM

(75) Inventors: Matthew Bruce Siemers, Ottawa (CA); Eric Irwin, Saint Joseph, MI (US); Leonard G. Lee, Almonte (CA); Lloyd Sevack, Nepean (CA)

(73) Assignee: Lee Valley Tools Ltd., Ontario (CA)

( * ) Notice: Subject to any disclaimer, the term of this patent is extended or adjusted under 35 U.S.C. 154(b) by 0 days.

(21) Appl. No.: 09/651,493

(22) Filed: Aug. 30, 2000

(51) Int. Cl.[7] ..... B24B 7/00

(52) U.S. Cl. ..... 451/278; 451/279; 451/293; 451/349; 451/456

(58) Field of Search ..... 451/57, 65, 340, 451/349, 456, 278, 279, 293

(56) References Cited

U.S. PATENT DOCUMENTS

| | | | | | |
|---|---|---|---|---|---|
| 1,191,045 | A | * | 7/1916 | Verwer | 451/65 |
| 1,259,494 | A | * | 3/1918 | Downer | 451/65 |
| 1,484,706 | A | * | 2/1924 | Furber | 451/65 |
| 1,581,919 | A | * | 4/1926 | Case | 451/65 |
| 2,307,312 | A | * | 1/1943 | Whiting | 451/548 |
| 2,418,744 | A | * | 4/1947 | Thwaites | 180/362 |
| 2,454,726 | A | * | 11/1948 | Tott | 451/511 |
| 2,644,280 | A | | 6/1953 | O'Neil, Jr. | |
| 2,662,353 | A | | 12/1953 | Bergman et al. | |
| 2,780,897 | A | * | 2/1957 | Radase | 451/65 |
| 2,814,171 | A | * | 11/1957 | Bogart | 451/456 |
| 3,221,783 | A | * | 12/1965 | Kaltenmark et al. | 30/376 |
| 3,267,623 | A | | 8/1966 | Block | |
| 3,438,410 | A | * | 4/1969 | Santilli | 30/389 |
| 3,605,343 | A | * | 9/1971 | Knecht | 451/65 |
| 3,680,264 | A | * | 8/1972 | Dewitt | 451/293 |
| 3,879,896 | A | * | 4/1975 | Maxfield et al. | 451/65 |
| 3,930,310 | A | * | 1/1976 | Santilli | 30/389 |
| 4,182,615 | A | * | 1/1980 | Weissman | 451/278 |
| 4,222,204 | A | | 9/1980 | Benner | |
| 4,228,618 | A | * | 10/1980 | Jensen | 451/456 |
| 4,259,814 | A | * | 4/1981 | Glaser et al. | 451/280 |
| 4,274,232 | A | | 6/1981 | Wylde | |
| 4,305,231 | A | * | 12/1981 | Rasmussen | 451/65 |
| 4,322,915 | A | * | 4/1982 | Kindig | 451/65 |
| 4,335,542 | A | * | 6/1982 | Howe | 451/65 |
| 4,574,530 | A | * | 3/1986 | Handler et al. | 451/340 |
| 4,607,464 | A | | 8/1986 | Schwartz | |

(List continued on next page.)

OTHER PUBLICATIONS

Bench Grinders, Garrett Wade, Aug. 1, 2000, www.garrettwade.com.

Sharpening Center, p. 81, Delta Catalog, admitted to have been published prior to Aug. 30, 2000.

Sharpening Tool, Japanese, admitted to have been published prior to Aug. 30, 2000.

*Primary Examiner*—M. Rachuba
(74) *Attorney, Agent, or Firm*—Kilpatrick Stockton; John Pratt; Geoffrey Gavin

(57) ABSTRACT

A powered sharpening system utilizing a turntable to rotate reversible, interchangeable platters carrying different grades of abrasive for grinding, polishing and lapping woodworking and other edge tools to be sharpened that are secured in a tool holder that contacts a reference surface on a tool rest to facilitate formation of bevels and micro-bevels at desired angles. Use of a platter of a first thickness followed by a thinner platter enables automatic formation of a micro-bevel without any adjustment in the tool holder, tool rest or sharpening technique. The turntable is rotated by an electric motor that also rotates a conventional abrasive wheel or a conventional narrow abrasive belt. The motor is mounted in a base within which a duct is located for coupling to a vacuum system for removing, through ports in the duct, abrasive and metal particles produced in grinding and sharpening. Blades on the underside of the turntable induce airflow through the base to cool the motor and other components.

45 Claims, 8 Drawing Sheets

U.S. PATENT DOCUMENTS 4,667,447 A 5/1987 Barton
4,805,353 A * 2/1989 Keith et al. ..... 451/361
4,807,404 A 2/1989 Lewis
5,168,656 A * 12/1992 Jolly et al. ..... 451/65
5,199,220 A * 4/1993 Steiner et al. ..... 451/65
5,231,801 A * 8/1993 Svetlik et al. ..... 451/456
5,251,407 A * 10/1993 Afshar ..... 451/349
5,311,703 A * 5/1994 Ketteringham ..... 451/65
5,545,081 A * 8/1996 Haffely et al. ..... 451/367
5,582,542 A 12/1996 Stein
5,637,036 A * 6/1997 Hepworth ..... 451/364
5,725,418 A * 3/1998 Giebmanns ..... 451/65
5,888,123 A * 3/1999 Wang ..... 451/65
6,095,906 A * 8/2000 Wang ..... 451/340
6,110,018 A * 8/2000 Hepworth ..... 451/48
6,244,938 B1 * 6/2001 Ploeger ..... 451/65

* cited by examiner

POWER SHARPENING SYSTEM

FIELD OF THE INVENTION

This invention relates to methods and devices for sharpening woodworking tools, including chisels, plane blades, carving tools, and knives. It relates, in particular, to rotating grinding, buffing, lapping, and polishing wheels and belts and other powered tool sharpening apparatus.

BACKGROUND OF THE INVENTION

Most woodworking hand tools require sharpening, especially new tools. Chisels, plane blades, carving tools, axes, drawknives, and other tools all need to be prepared for use by grinding and polishing two intersecting surfaces to create a keen cutting edge or arris. Tool use dulls and sometimes damages this arris, making periodic re-sharpening necessary. Many tool sharpening devices and techniques have been developed, but tool sharpening and re-sharpening remains difficult for many tool users because of the substantial practice, skill and time needed to utilize many sharpening devices and techniques successfully. Additionally, widespread unfamiliarity with well-sharpened tools makes it difficult for many tool users to accurately judge the quality of sharpening results.

All relevant sharpening techniques involve abrading tool surfaces with abrasive materials, such as natural or man-made stones, or with abrasive particles deposited on another substrate. Among existing products intended for sharpening woodworking hand-tools are high-speed, "dry" grinding wheels that do not use lubrication and low-speed "wet" wheels that use lubrication on the wheel surface, typically water. Some of these products utilize relatively large diameter vertical wet or dry grinding or honing wheels, where the wheel edge is the principal working surface. Others utilize horizontal wheels where one face of the wheel is the principal working surface. A variety of abrasive "stones" usually having flat surfaces are available for manual sharpening.

One of the challenges associated with use of all abrasive wheels and manual stones is wheel or stone surface shape. Wear during use invariably causes stone or wheel surfaces to become uneven, requiring dressing of those surfaces to restore the desired shape and often resulting in changes in the distances between such surfaces and associated tool guides and rests. These changes in system geometry as a result of stone wear, and shortcomings of existing tool guides and rests make it extremely difficult or impossible with most existing devices to achieve reproducible sharpening geometries that produce reproducible sharpening angles on the tools being sharpened. Depending on the type of tool, the way it was manufactured, the materials from which it was manufacture and its intended use, certain specific bevel angles are required for the cutting edge. Once a specific, successful bevel angle is achieved, the user will want to reproduce that same angle as closely as possible when the tool requires resharpening.

Additionally, existing sharpening products have no provision for grinding and polishing both surfaces of many cutting tools such as plane blades and chisels, because they have no provision or only inadequate provisions for grinding and polishing or "lapping" the back of such tools, which is required successfully to sharpen such tools.

To be practical and effective, any abrasive operation like tool sharpening must use several grades of abrasives to progress from shaping and forming of the tool's surface to the desired level of surface finish. The more highly polished the surface finish needs to be, the more abrasive steps are required. Typical tool sharpening requires a broad range of abrasive grades because sharpening starts with formation of the principal bevel or back surface by grinding and ends with polishing to a mirror finish.

SUMMARY OF THE INVENTION

Among other desiderata that result from the considerations mentioned above, a sharpening system desirably should provide:

- a wide range of abrasive grades
- a highly functional tool holding and guiding system
- controllable, reproducible system geometry, particularly relative to the relationship between the tool holder and guide (and therefore the tool being sharpened) and the abrasive surface;
- an absolutely flat abrasive surface
- easily renewable abrasive surfaces
- flexibility in accommodating a wide range of tool sizes and shapes
- modest generation of heat in the tool to avoid metallurgical damage
- safe operation
- speed.

These and other desirable objectives associated with tool sharpening are achieved by this invention.

This sharpening system combines a relatively slowly rotating horizontal turntable and, alternatively, either a rotating vertical grinding wheel or belt. The belt and/or wheel may be used for grinding, shaping, and in some cases, sharpening, a wide variety of woodworking tools in a relatively conventional manner. The rotating turntable is topped, during use, by a platter to which abrasive has been attached by bonding a plastic or fabric sheet coated with abrasive or a disk of cloth charged with abrasive. Abrasive may be positioned on both sides of the platter, making the platter reversible, and multiple platters may be used. Relatively slow turntable rotation limits heat buildup during use.

A tool such as a plane blade or chisel to be sharpened (and already having a properly lapped back) is secured in a tool holder that rests and travels against a repositionable tool rest or tool guide fixed in position relative to the turntable in order to form a main bevel on the tool at a desired angle. That bevel is formed utilizing a first grade of abrasive affixed to a platter having a particular thickness and that is mounted on the turntable. A second, thinner platter having a finer grade abrasive is then mounted on the turntable. Contact between the tool and the abrasive on the second platter (without changing any other aspect of the system or tool holder geometry) then automatically produces a micro-bevel to complete tool sharpening because the tool contacts the abrasive on the thinner platter at a slightly greater angle. Thus, abrasion occurs only at the very front of the bevel adjacent to the arris where it is needed to hone the cutting edge or arris. This minimizes the amount of abrasion required, and consequently lengthens the working life of the abrasive and reduces the time needed for sharpening.

The back of a tool such as a plane blade or chisel may be lapped flat against an appropriate grade of abrasive mounted on a platter positioned atop the rotating turntable.

DETAILED DESCRIPTION

As will be appreciated by reference to the Figures, the sharpening system 20 of this invention utilizes a base 22 that may be a generally hollow structure cast, fabricated, formed or molded of a variety of materials including suitable plastics, cast iron and aluminum.

Figure 1:
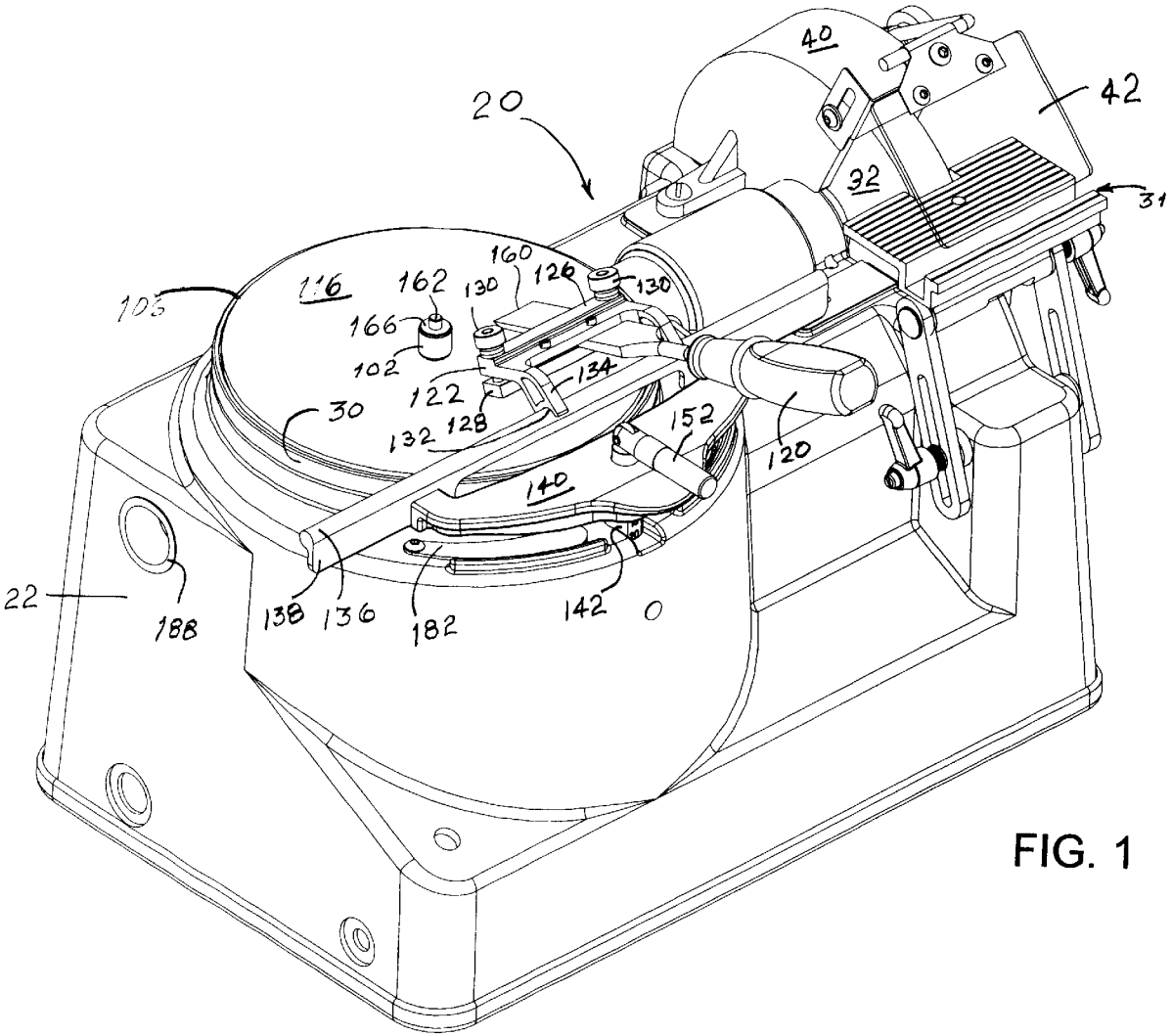
FIG. 1 is a perspective view of the sharpening system of this invention shown with a vertical grinding wheel and cover mounted on the right side of the device and with a chisel being sharpened.
Figure 2:
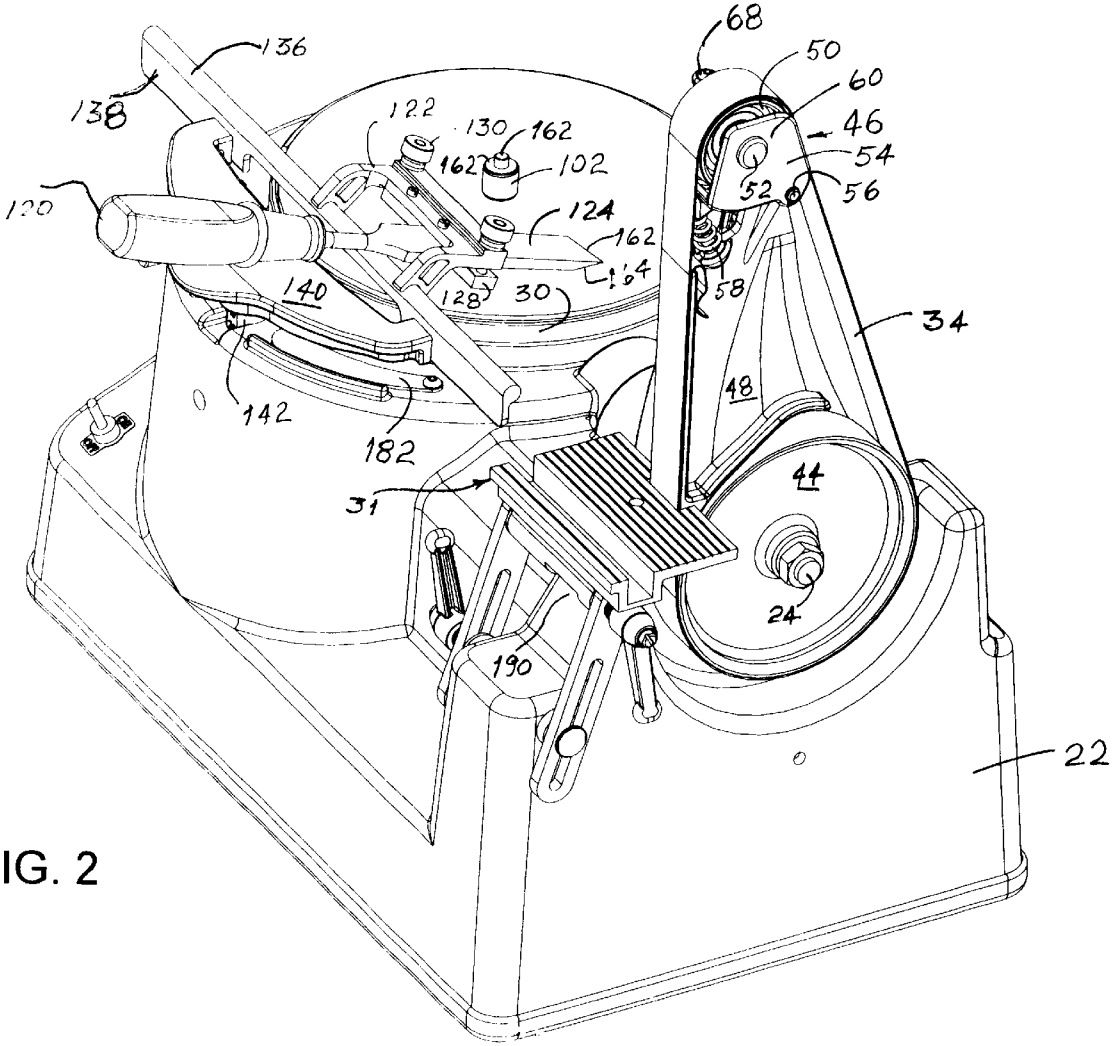
FIG. 2 is a perspective view of the system shown in FIG. 1 with an abrasive belt attachment substituted for the vertical grinding wheel and its cover shown in FIG. 1.
Figure 3:
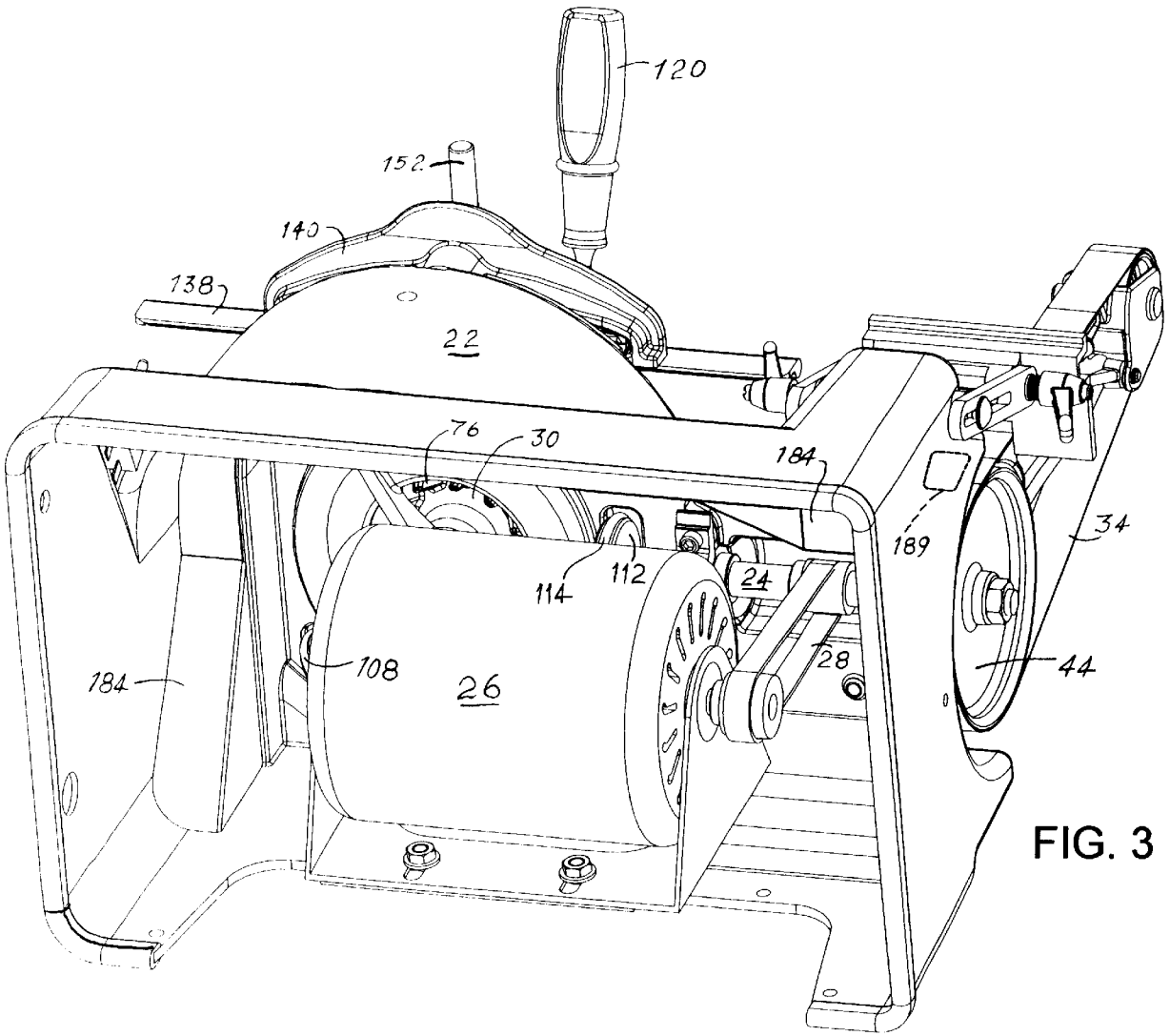
FIG. 3 is a perspective view of the underside of the system shown in FIG. 2.

Base 22 holds a horizontal drive shaft 24 (visible in FIG. 3) that is driven by a motor 26 mounted inside base 22. Numerous alternatives could be used for coupling the motor 26 to the drive shaft 24, including round or vee-shaped belts, gears and other coupling means, but a single flat belt 28 provides a compact, efficient method for coupling motor 26 to shaft 24. Shaft 24 drives a horizontal turntable 30 on the left side of base 22 and, on the right side of base 22, alternatively, either a vertical grinding wheel 32 (illustrated in FIG. 1) or a narrow abrasive belt 34 illustrated in FIG. 2.

Figure 4:
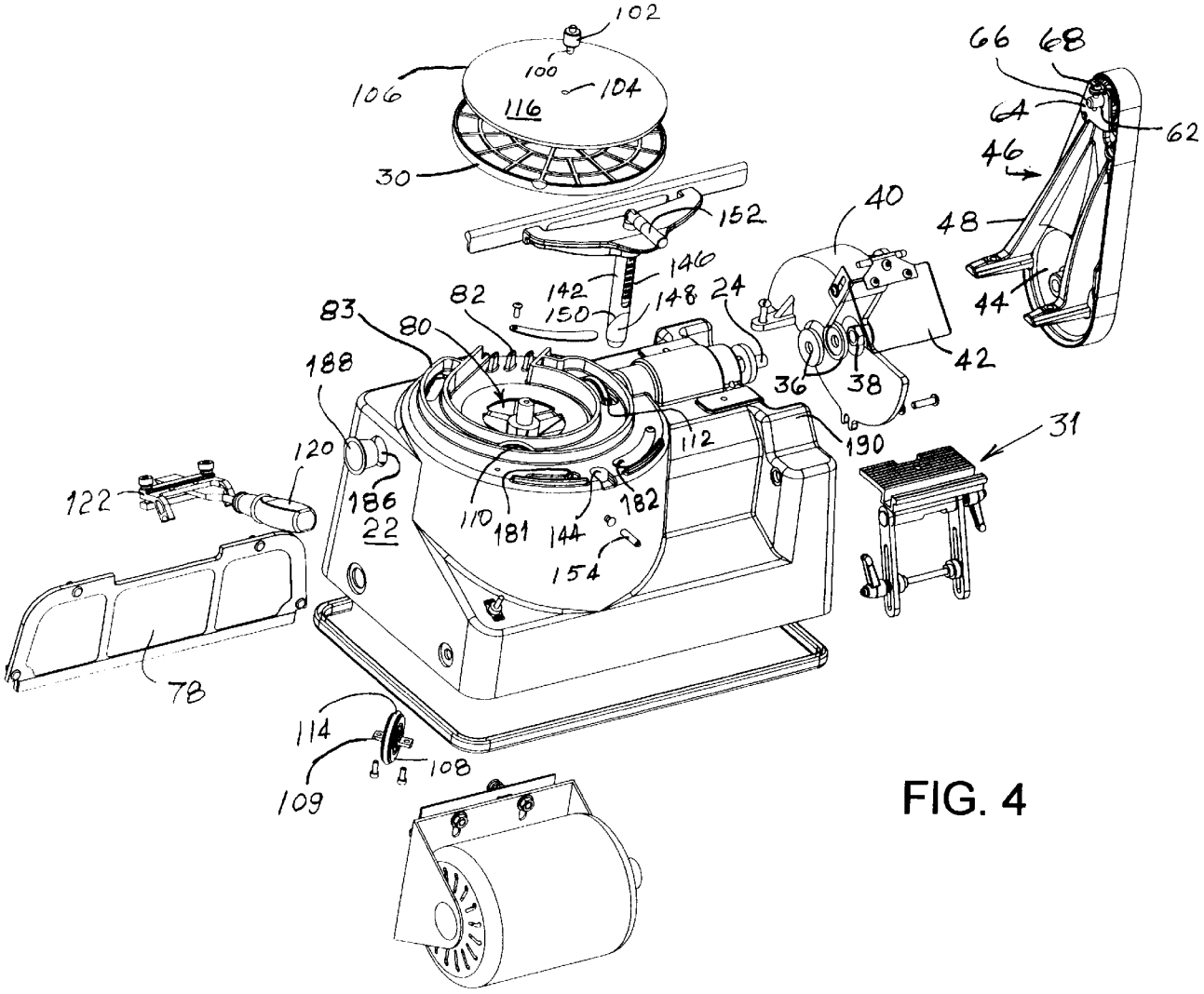
FIG. 4 is an exploded perspective view of the sharpening system of this invention shown with the components for use of either a grinding wheel or a grinding belt.
Figure 5:
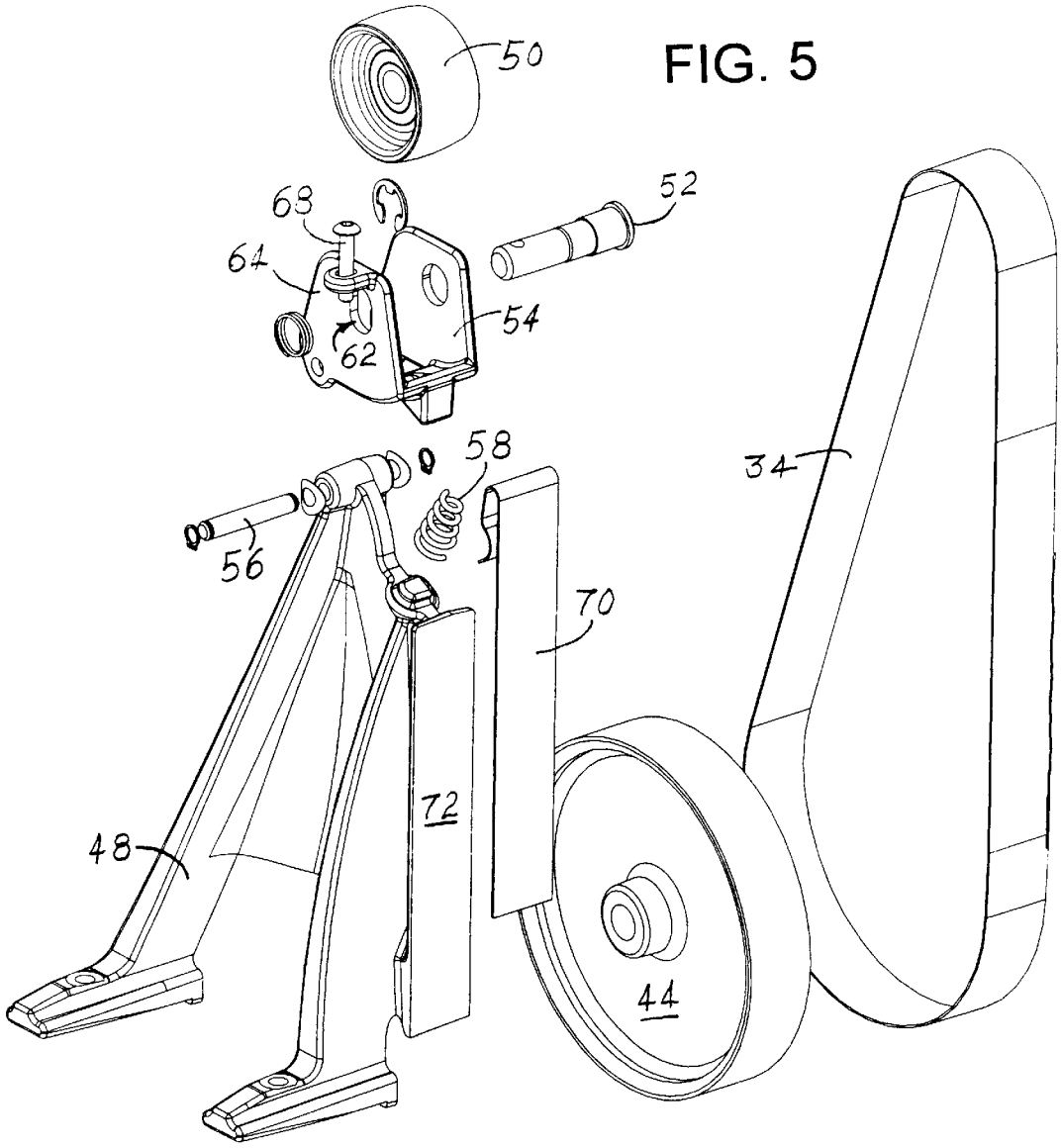
FIG. 5 is exploded perspective view of the belt grinder assembly shown in place on the system in FIG. 2.

When using the grinding wheel alternative, the grinding wheel 32 is secured to drive shaft 24 with washers 36 and a nut 38 (visible in FIG. 4) and is covered with a guard 40 and eye shield 42.

Alternatively, a belt drive wheel 44 may be mounted on shaft 24 while other components of the belt assembly 46 are mounted on the base 22. Generally, these components include a stanchion 48 that is secured to the base 22 and that supports belt idler wheel 50 over which abrasive belt 34 runs. Belt idler wheel 50 runs on a shaft 52 secured in an idler yoke 54 that is pivotally connected to stanchion 48 by a pin 56. Yoke 54 is urged to pivot upward by spring 58 between the stanchion 48 and yoke 54 to thereby tension belt 34 around idler wheel 50 and drive wheel 44. Idler wheel shaft 52 is secured in a round hole in the right side 60 of idler yoke 54 and in a slot 62 in the left side 64 of idler yoke 54 so that the end 66 of idler shaft 52 in slot 62 may be moved up and down by a screw 68 attached to yoke 54 and threaded into the end 66 of shaft 52. Thus, adjustment of screw 68 tilts shaft 52 and idler wheel 50 in order to cause belt 34 to run true. Belt 34 bears against a spring steel belt platen shoe 70 that clips on the face of stanchion 48 platen 72. A flat platen shoe 70 is illustrated, but a convex shoe can also be used so that hollow grinding can be accomplished against belt 34. A vertical grinder tool rest assembly 31 provides positioning for tools relative to either the grinding wheel 32 or belt 34.

Figure 6:
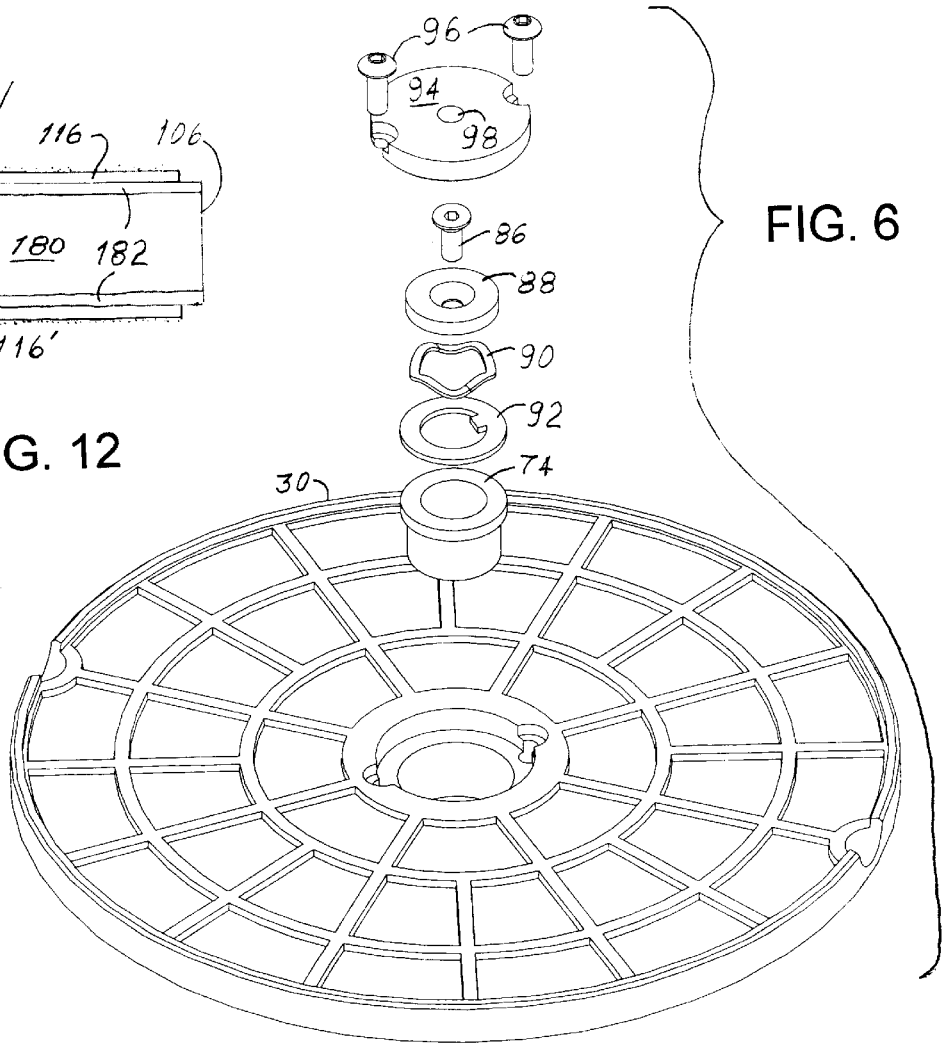
FIG. 6 is an exploded perspective view of the turntable bushing and components that hold the turntable in place on the sharpening system of this invention.
Figure 7:
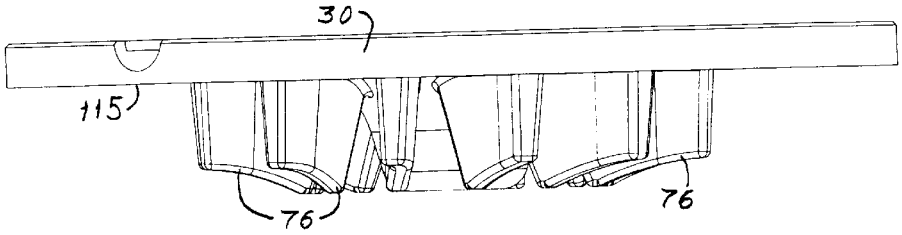
FIG. 7 is an elevation view of the turntable.

Drive shaft 24 also rotates the turntable 30, which may be cast aluminum or other suitable materials, including other metals and alloys and plastics and composites. As is illustrated in FIG. 6, a bronze bushing 74, such as an Oilite® flange bushing, is press fit in turntable 30, which has air fins or blades 76 on its underside that draw air for cooling purposes through filter 78 mounted in the back of base 22 into the interior of base 22, through openings 80 in base 22 under turntable 30, and out between safety pins 82 in base 22, as well as through the clearance between the underside of the turntable 30 and the close adjacent cast projections assign number assign number in base 22. Pins 82 prevent a user's fingers from contacting fins 76 on the underside (see FIG. 7) of turntable 30. The positive air flow emanating between turntable 30 and base 22 aids in preventing abrasive particles from entering the rotating drivetrain components (bushings and bearings).

Stub axle post 84 is received in bearing 74 in turntable 30, so that turntable 30 can rotate. Through clearance between the stub axle 84 and bearing 74, turntable 30 can also rock slightly on post 84 to insure firm contact with wheels 108, 110, and 112 and accommodate uneven wear of those wheels.

In some aspects of operation of the system 20, such as when a shaped-edge felt wheel is mounted on turntable 30, upward pressure is exerted on platen 30, thus making it desirable that turntable 30 be mounted in a manner that resists such upward pressure. Firm contact with drive wheel 112 is also desirable. As may be seen in FIG. 6, this contact and retention is accomplished by placing turntable 30 with bushing 74 around stub axle post 84 and then securing turntable 30 in place using screw 86 passing through washer 88, spring washer 90 and keyed to tab washer 92. Keyed washer 92 is received on axle post 84, which carries a key way. Disk 94, essentially a thick metal washer, is secured above axle post 84 in the center of turntable 30 with screws 96. A threaded center hole 98 in Disk 94 receives a threaded post 100 on platter thumb screw 102, which post 100 passes through center hole 104 in interchangeable abrasive-bearing platter 106 and thereby secures platter 106 to turntable 30.

Turntable 30 rests on three wheels 108, 110, 112, each of which wheels is shod with a resilient tire 114, that may be an o-ring of neoprene, rubber, nitrile (Buna-N, a copolymer of butadiene and acrylonitrile), silicone, EPDM, Butyl or other suitable material. As will be appreciated by reference to FIGS. 3, 4 and 7, wheel 112 is positioned on drive shaft 24 so that its tire 114 contacts a smooth, flat portion 115 of the underside of turntable 30 and imparts rotational motion to turntable 30 when drive shaft 24 is rotating. Wheels 108 and 110 ride on axles 109 that mount on base 22. Rotational speed of turntable 30 is a function of the speed of drive shaft 24, wheel 112 diameter, and the distance from the center of turntable 30 to the point where wheel 112 contacts the underside 115 of turntable 30. A turntable speed of approximately 650 revolutions per minute works well.

Rotational speed of grinding wheel 32 or belt drive wheel 44 is a function of the speed of drive shaft 24. A drive shaft 24 speed of approximately 1750 revolutions per minute facilitates use of grinding wheel 32 or belt 34 with less heat buildup and a consequently smaller risk of tool damage than when using a conventional wheel grinder that normally operates at about 3600 revolutions per minute.

Each side of each interchangeable platter 106 may be topped with a pressure sensitive adhesive-backed abrasive sheet 116, such as 3M® Imperial™ microfinishing film in a grade such as 100 microns, 60 microns, 40 microns, or 9 microns (polyester film backing coated with resin-bonded micron-graded mineral particles that are electrostatically oriented). Coarser abrasives may also be used such as 80, 120 or 180 zirconia abrasive disks, which are typically manufactured with a fabric substrate. Alternatively, a platter 106 may be topped with a layer of fabric, such as woven cotton broadcloth bonded to the platter 106 with rubber cement. This cloth may then be charged with abrasive compound such as Veritas® blade honing compound (containing chromium oxide) available from Lee Valley Tools, Ltd.

Figure 12:
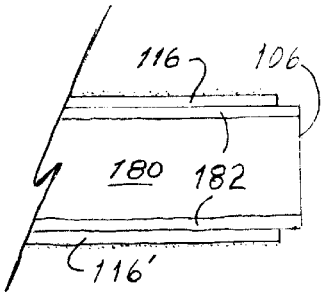
FIG. 12 is an enlarged side elevation view of a portion of a reversible platter for use on the turntable of the sharpening system of this invention with abrasive sheets on both sides.

Platters 106 should be of a specific thickness and as flat as possible so that when laid on a surface plate and checked with a precision measuring instrument such as a dial indicator, the distance from the highest to the lowest spot on any one side of a platter 106 is no more than 0.005". Platters 106 could be formed of solid metals, such as steel or aluminum, and could be plastic or plastic composites. Such platters may also be structures having multiple laminations. For instance, as illustrated in FIG. 12, platters 106 may have a thermoplastic core 180 bonded between two aluminum skins 182 (e.g., 0.020 inch gauge aluminum sheets) and sold under the name AlucoBond®, available from Alusuisse Composites, Inc., 55 West Port Plaza, Ste. 625, St. Louis, Mo. 63146. FIG. 12 is an enlarged elevation view of a portion of the edge of a platter 106 with sheets of abrasive 116 and 116' on each side. A first sheet of coated abrasive 116 is bonded to one side of platter 106 and a second sheet 116' is bonded to the opposite side.

By use of platters 106 of differing thicknesses, slight grinding angle changes may automatically be achieved. For instance, a first platter 106 four millimeters thick and having a courser abrasive 116 (e.g., 100 micron abrasive) may be used to produce a principal bevel on a woodworking tool, such as bevel 164 on chisel 120. After producing bevel 164, a second platter 106, three millimeters in thickness and preferably having a finer grade abrasive 116 (e.g., 9 micron abrasive), may be substituted on top of platen 30. This will cause chisel 120 to contact abrasive 116 at a slightly greater angle, producing a micro-bevel without changing any apparatus settings.

Figure 8:
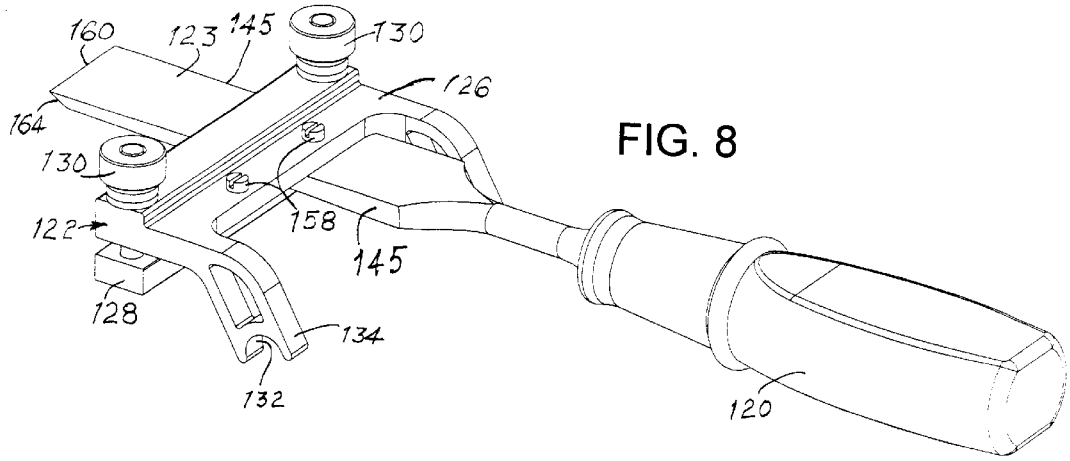
FIG. 8 is a perspective view of the tool holder of this invention shown holding a bench chisel.

A tool, such as chisel 120, to be sharpened utilizing system 20 is locked in a tool holder 122 by clamping the tool blade 124 between the holder body 126 and a holder bar 128 by tightening thumb nuts 130, as illustrated in FIG. 8. Concavities 132 in feet 134 of tool holder body 126 rest and slide against a horizontal semi-cylindrical surface 136 of a tool guide or tool rest 138. A rest holder yoke 140 positioned atop a tool rest post 142 supports tool rest 138. It is important that tool rest 138 be parallel to the surface of platter 106 when mounted on turntable 30 so that a tool blade such as blade 124 will be properly ground when the blade 124 is secured on tool holder 122 and the holder is used as described below in contact with tool rest 138. Accordingly, it is desirable that tool rest 138 be adjustably attached to rest holder yoke 140 so that such a parallel relationship can be established and maintained. This can be accomplished, for instance, by securing rest 138 to yoke 140 with screws 141 (see FIG. 11) that pass through elongated holes or slots in rest 138 and into yoke 140, allowing the position of rest 138 to be adjusted before the screws 141 are tightened.

The position of tool post 142 in hole 144 in base 22 is adjustable, and the projection of post 142 (and therefore the height of tool rest 38 relative to turntable 30 and platter 106) is indicated by indicia 146 on post 142 (as further described below). Post 142 may have a bottom section 148 separated from post 142 by oblique surfaces 150. Post 142 is locked in hole 144 in base 22 by drawing section 148 upward utilizing a threaded rod (not shown) manipulated by handle 152, a structure like that used for securing a bicycle handlebar post to the front forks. Predetermining alternative positioning of post 142 may be facilitated by receiving a spring-loaded pin 154 positioned in base 22 in detents (not shown) in the back of post 142

Figure 10:
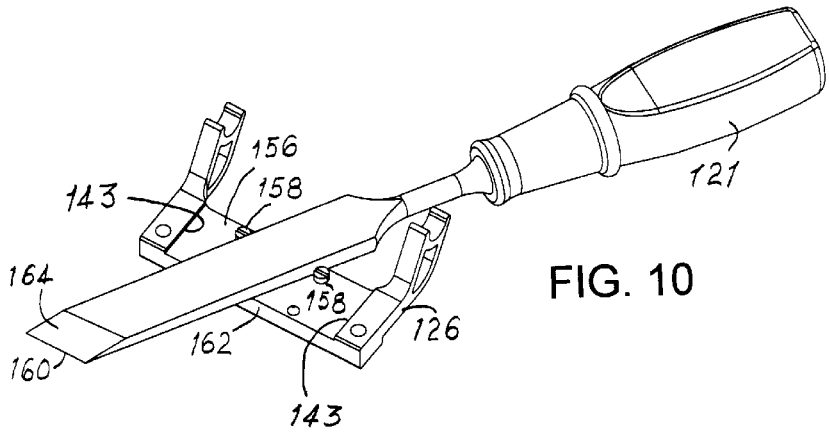
FIG. 10 is a perspective view of positioning of a skew chisel on the body of the tool holder shown in FIGS. 8 and 9.
Figure 9:
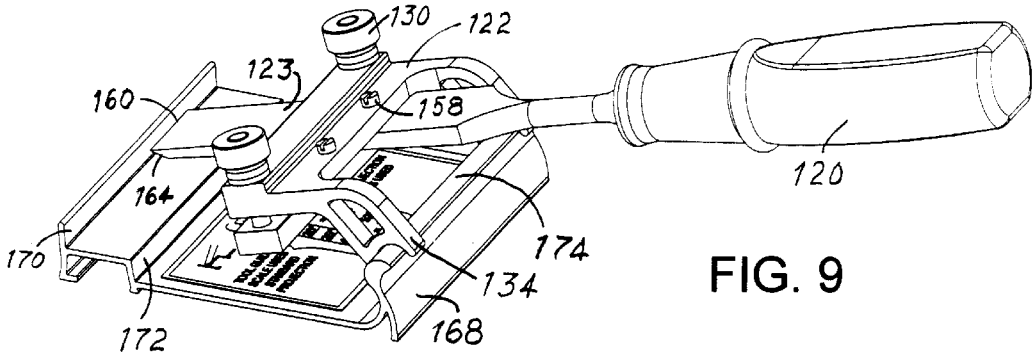
FIG. 9 is a perspective view of the tool holder of this invention being used with the blade projection-setting jig of this invention.

Reproducible predetermined grinding angles may be achieved by controlling the height of tool rest surface 36 and the projection of a blade or cutter to be sharpened from tool holder 122. Positioning a tool such as chisel 120 in tool holder 132 and securing it with proper projection of the blade 123 may be understood by reference to FIGS. 8–11. As can be well understood by reference to FIG. 8, blade 123 is secured in tool holder 122 by clamping the blade between the lower surface 156 of tool holder body 126 (see FIG. 10) and the upper surface 158 of holder bar 128 by tightening thumb screws 130 to draw bar 128 toward body 126. In some instances, such as when a skew chisel (such as skew chisel 121 shown in FIG. 10) is being secured in tool holder 122, it is desirable to have pins for the chisel 121 to bear against. These may be provided by positioning screws 158 having cylindrical heads in surface 156, of tool holder body 126, as illustrated in FIG. 10. When not in use, such screws 158 can be positioned on body 122 as shown in FIGS. 8 and 9, where they are out of the way.

A chisel 120 having a cutting arris 160 that is square to the blade 123 and can be positioned square in the holder 122 by positioning one side 145 of the blade 123 against a registration surface 143 (visible in FIG. 10) of the holder 122 body 126.

A select predetermined projection of blade 123 from tool holder 128 is virtually always desired. Among other ways, such predetermined projection may be achieved as follows.

Figure 11:
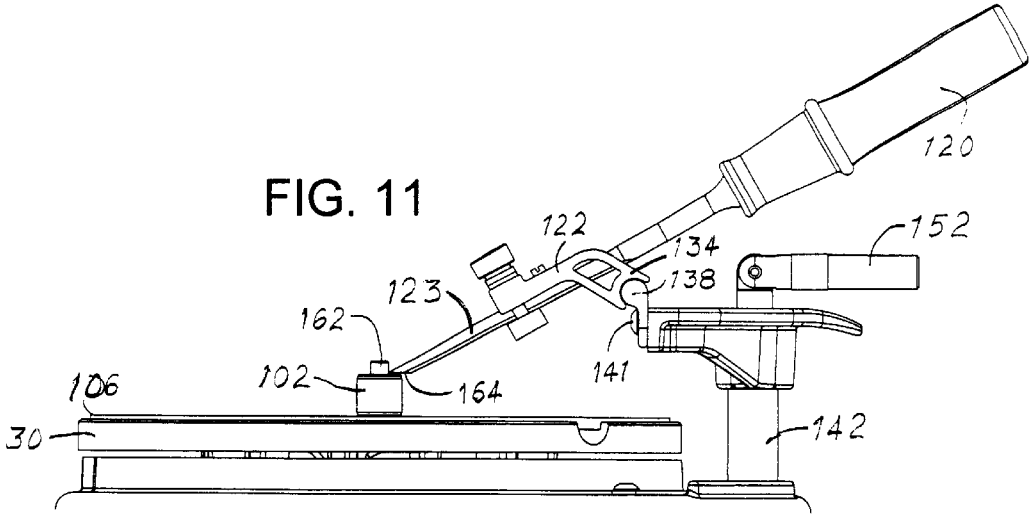
FIG. 11 is an end elevation view of the turntable and tool rest portion of the system shown in FIGS. 1–4 with a bench chisel being positioned in the tool holder shown in FIGS. 8 and 9.

In order for a tool such as blade 123 to be properly positioned in tool holder 122, it is necessary for the existing (or desired) cutting arris 160 to be parallel to the front edge 162 of tool holder body 126 and a predetermined distance from body 126, and, more specifically, a predetermined distance from the arcuate surfaces 132 of feet 134 of tool holder 122 that ride on tool rest surface 36. Such projection may be achieved by positioning the arcuate surfaces 132 in a predetermined location and adjusting blade 123 until arris 160 is at a location a predetermined distance from the arcuate surfaces 132. This may be accomplished as illustrated in FIG. 11 by positioning post 142 of tool rest 138 a predetermined projection from base 22, positioning tool holder 122 with arcuate surfaces 132 on tool rest 138, and then adjusting the position of blade 123 in tool holder 122 until cutting arris 160 contacts the knob 162 on thumbscrew 102. After blade 123 projection from holder 122 has been set, the height of tool rest 138 can be adjusted to achieve different desired grinding and sharpening angles, which may be read from indicia 146 on tool rest post 142.

A second technique for positioning the projection of a tool to be sharpened, such as blade 123 of chisel 120, utilizes a positioning jig 168. Such a jig 168 may be formed of extruded aluminum so that a convex arcuate surface 174 is provided to receive concave arcuate surfaces 132 of jig 122 feet 134. Arcuate surface 174 is fixed in relation to a first step 170 and second step 172. As is illustrated in FIG. 9, the arris 160 of a blade 123 is positioned against step 170 with the feet 134 of tool holder 122 positioned on arcuate surface 174, and the blade is then locked in place by rotating thumb screws 130 to clamp the blade 123 with bar 128. Blades having shorter projection can be positioned instead by reference to step 172, which will provide a different grinding angle for a particular position of tool rest 138. However, most desired grinding angles can still be achieved by raising or lowering tool rest 138.

As will be understood by those skilled in the art in light of the description above and the accompanying drawings, other tool holders can be fabricated for holding other tools to be sharpened utilizing the system 20 of this invention. For instance, tool holders can be made to grasp considerably wider or longer blades such as, for instance, planer blades or jointer knives.

Similarly, alternative jigs and methods can be utilized for setting the projection of blades from tool holder 122 or alternative tool holders. Additionally, alternative tool rests can easily be substituted for the tool rest 138 illustrated and described herein by, for instance, fabricating different tool rest structures that attach to post 142 received in posthole 144 in base 22.

Alternatives to platters 106 may also be attached to and used on turntable 30. For instance, a felt buffing wheel can be mounted on turntable 30 by passing a bolt through a washer and the wheel (and through a buffing wheel bushing if needed) and into the threaded hole 98 in disk 94. A spacer may be desirable between turntable 30 and the buffing wheel in order to raise the buffing wheel above the turntable and thereby make the edge of the buffing wheel more accessible.

Particles and debris from sharpening and grinding can be drawn from the turntable 30 area into ports 181 in base 22 (see FIG. 4) below tool rest 138 and from the grinding wheel 32 or belt 34 into a grinder port 189 in the base 22 adjacent to the wheel 32 or belt 34. Such a grinder port 189 may be located, as shown in a broken line in FIG. 3, on the backside of upstanding portion 190 (indicated in FIG. 4) of base 22. When the grinding wheel 32 or belt 34 is in use, ports 181 may be covered by shutters 182 that may be made of sheet metal such as brass or other appropriate materials. Ports 181 and the grinder port 189 communicate with a duct formed within base 22 by duct cover 184 (see FIG. 3) to which a vacuum system, such as a vacuum cleaner, shop vacuum or dust collector, may be attached at vacuum opening 186 in base 22 (see FIGS. 1 and 4). The duct under cover 184 also ensures that abrasive laden air remains isolated from the airflow created by turntable 30 blades 76 and described above for motor cooling and drivetrain cleanliness purposes. Vacuum opening 186 can be closed by a cap 188 when not in use.

As will be readily understood by reference to the forgoing description, the accompanying drawings and following claims, numerous other modifications can be made in the power sharpening system of this invention without departing from the spirit of the invention or the scope of the following claims.

We claim:

1. A sharpening system, comprising:

a turntable;

at least two interchangeable platters of different thicknesses for carrying abrasive and for alternative mounting on and rotation by the turntable; and a tool holder for holding a tool with a longitudinal axis while contacting with the tool:

(a) first abrasive on a face of one of the platters in a first plane at a first angle between the longitudinal axis of the tool and the first plane when the one platter is mounted on the turntable and (b) second abrasive on a face of a second of the platters in a second plane at a different angle between the longitudinal axis of the tool and the second plane when the second platter is mounted on the turntable.

2. The sharpening system of claim 1, further comprising a tool rest positionable in alternative fixed locations relative to the turntable for sliding contact between the tool rest and the tool holder when the tool is contacting abrasive on a face of one of the platters.

3. The sharpening system of claim 1, wherein the turntable contacts three wheels, one of which is driven to impart rotational motion to the turntable.

4. The sharpening system of claim 3, wherein the driven wheel carries a resilient tire and is driven by an electric motor.

5. The sharpening system of claim 4, wherein the driven wheel is mounted on a drive shaft driven by the electric motor and the drive shaft has an end remote from the driven wheel.

6. The sharpening system of claim 5, wherein the drive shaft is adapted to be secured to and rotate a grinding wheel.

7. The sharpening system of claim 5, wherein the drive shaft is secured to and rotates a drive wheel for an abrasive belt.

8. The sharpening system of claim 7, further comprising an abrasive belt stanchion supporting at least one idler wheel for the abrasive belt.

9. The sharpening system of claim 1, further comprising a vacuum duct for coupling to a vacuum system and having at least one vacuum port adjacent to the turntable.

10. The sharpening system of claim 5, further comprising a vacuum duct for coupling to a vacuum system and having at least one vacuum port adjacent to the turntable and at least one other vacuum port adjacent to the remote end of the drive shaft.

11. The sharpening system of claim 9, further comprising a shutter for selectively closing the vacuum port.

12. The sharpening system of claim 10, further comprising at least one shutter for selectively closing at least one of the vacuum ports.

13. The sharpening system of claim 1, further comprising fins on the turntable for inducing air flow for cooling purposes.

14. The sharpening system of claim 1, further comprising bearing surfaces, and fins on the turntable for inducing air flow for limiting contamination of the bearing surfaces.

15. The sharpening system of claim 1, further comprising bearing surfaces, a duct within which debris may be drawn away from the vicinity of the turntable and means for inducing air flow for cooling purposes and to limit contamination of the bearing surfaces.

16. The sharpening system of claim 1, wherein the platters each comprise a thermoplastic core clad with aluminum.

17. A power sharpening system, comprising:

(a) a base, (b) an electric motor mounted within the base for driving (c) a generally horizontal drive shaft having two ends, (d) a turntable drive wheel mounted on one end of the drive shaft, the drive wheel for driving (e) a generally horizontal turntable, (f) at least two platters of different thicknesses alternatively mountable on the turntable for rotating abrasive secured to the platters in a generally horizontal plane, (g) structure on the other end of the drive shaft for mounting thereon either:

(1) a grinding wheel or (2) an abrasive belt drive wheel, (h) structure on the base for mounting thereon either a grinding wheel guard or an abrasive belt idler wheel support, (i) a grinder toot rest mounted on the base proximate the other end of the drive shaft, (j) a sharpening tool rest mounted on the base proximate the turntable, and (k) a duct within the base for coupling to a vacuum system and having at least one port proximate the turntable and at least one other port proximate the other end of the drive shaft.

18. A sharpening system, comprising:

a turntable;

at least two interchangeable platters of different thicknesses for carrying abrasive and for alternative mount on and rotation by the turntable;

a base on which the turntable is mounted; and a drive shaft having two ends and secured to the base so that one of the ends can rotate either a generally vertical grinding wheel or a drive wheel for an abrasive belt and the other end can rotate the turntable.

19. The sharpening system of claim 18, further comprising a sharpener tool rest positionable in alternative locations relative to the turntable for contact between the tool rest and either a tool or a tool holder when the tool is contacting abrasive on a face of one of the platters.

20. The sharpening system of claim 18, further comprising a grinder tool rest proximate the one drive shaft end for use with the grinding wheel or the abrasive belt.

21. The sharpening system of claim 18, further comprising means for securing one of the platters to the turntable.

22. The sharpening system of claim 18, further comprising a fastener for securing one of the platters to the turntable, the fastener comprising a threaded post.

23. The sharpening system of claim 21, wherein the securing means further comprises at least one reference surface that can be contacted by a tool being positioned in a tool holder in contact with the tool rest.

24. The sharpening system of claim 19, further comprising a tool holder for holding a tool while the tool holder contacts the tool rest and the tool contacts abrasive on a face of one of the platters.

25. The sharpening system of claim 22, wherein the fastener comprises two reference surfaces that can be contacted by a tool rest positioned in a tool holder in contact with the sharpener tool rest.

26. A sharpening system, comprising:

a turntable;

at least two interchangeable platters of different thicknesses for carrying abrasive and for alternative mounting on and rotation by the turntable;

a base on which the turntable is mounted;

a drive shaft having two ends and secured to the base so that one of the ends can rotate either a generally vertical grinding wheel or a drive wheel for an abrasive belt and the other end can rotate the turntable; and a tool holder for holding a tool with a longitudinal axis while contacting with the tool:

first abrasive on a face of one of the platters in a first plane at a first angle between the longitudinal axis of the tool and the first plane when the one platter is mounted on the turntable, and second abrasive on a face of a second of the platters in a second plane at a different angle between the longitudinal axis of the tool and the second plane when the second platter is mounted on the turntable.

27. The sharpening system of claim 26, further comprising a sharpener tool rest positionable in alternative locations relative to the turntable for contact between the tool rest and either the tool or the tool holder when the tool is contacting abrasive on a face of one of the platters.

28. The sharpening system of claim 26, further comprising a grinder tool rest proximate the one drive shaft end for use with the grinding wheel or the abrasive belt.

29. A sharpening system comprising:

a turntable;

at least two interchangeable platters of different thicknesses for carrying abrasive and for alternative mounting on and rotation by the turntable;

a base on which the turntable is mounted;

a drive shaft having two ends and secured to the base so that one of the ends can rotate either a generally vertical grinding wheel or a drive wheel for an abrasive belt and the other end can rotate the turntable; and a tool holder for holding a tool while contacting with the tool abrasive on a face of one of the platters.

30. The sharpening system of claim 29, further comprising a sharpener tool rest positionable in alternative locations relative to the turntable for contact between the tool rest and either the tool or the tool holder when the tool is contacting abrasive on a face of one of the platters.

31. The sharpening system of claim 29, further comprising a grinder tool rest proximate the one drive shaft end for use with the grinding wheel or the abrasive belt.

32. The sharpening system of claim 29, further comprising a vacuum duct for coupling to a vacuum system and having at least one vacuum port adjacent to the turntable.

33. The sharpening system of claim 32, further comprising at least one shutter for selectively closing at least one of the vacuum ports.

34. A sharpening system, comprising:

a turntable;

at least two interchangeable platters of different thicknesses for carrying abrasive and for alternative mounting on and rotation by the turntable;

a tool holder for holding a tool with a longitudinal axis while contacting with the tool:

first abrasive on a face of one of the platters in a first plane at a first angle between the longitudinal axis of the tool and the first plane when the one platter is mounted on the turntable, and second abrasive on a face of a second of the platters in a second plane at a different angle between the longitudinal axis of the tool and the second plane when the second platter is mounted on the turntable; and means for securing one of the platters to the turntable.

35. The sharpening system of claim 34, further comprising a sharpener tool rest positionable in alternative locations relative to the turntable for contact between the tool rest and either the tool or the tool holder when the tool is contacting abrasive on a face of one of the platters.

36. The sharpening system of claim 34, further comprising a base on which the turntable is mounted.

37. The sharpening system of claim 36, further comprising an electric motor mounted within the base.

38. The sharpening system of claim 37, further comprising a drive shaft being driven by the electric motor.

39. The sharpening system of claim 34, wherein the platters each comprise a thermoplastic core clad with aluminum.

40. The sharpening system of claim 34, further comprising fins on the turntable for inducing air flow for cooling purposes.

41. A sharpening system, comprising:

a turntable mounted on a base;

at least two interchangeable platters of different thicknesses for carrying abrasive and for alternative mounting on and rotation by the turntable;

a tool holder for holding a tool with a longitudinal axis while contacting with the tool:

first abrasive on a face of one of the platters in a first plane at a first angle between the longitudinal axis of the tool and the first plane when the one platter is mounted on the turntable, and second abrasive on a face of a second of the platters in a second plane at a different angle between the longitudinal axis of the tool and the second plane when the second platter is mounted on the turntable;

a sharpening tool rest mounted on the base proximate the turntable; and a duct within the base for coupling to a vacuum system and having at least one port proximate the turntable.

42. The sharpening system of claim 41, wherein the sharpening tool rest is positionable in alternative locations relative to the turntable for contact between the tool rest and either the tool or the tool holder when the tool is contacting abrasive on a face of one of the platters.

43. The sharpening system of claim 41, wherein the platters each comprise a thermoplastic core clad with aluminum.

44. The sharpening system of claim 41, further comprising an electric motor mounted within the base.

45. The sharpening system of claim 41, further comprising bearing surfaces and fins on the turntable for inducing air flow for limiting contamination of the bearing surfaces.

* * * * *